US005188660A

United States Patent [19]

Tosun et al.

[11] Patent Number: 5,188,660

[45] Date of Patent: Feb. 23, 1993

[54] PROCESS FOR MAKING FINELY DIVIDED PARTICLES OF SILVER METALS

[75] Inventors: Guray Tosun; Howard D. Glicksman, both of Wilmington, Del.

[73] Assignee: E. I. Du Pont de Nemours and Company, Wilmington, Del.

[21] Appl. No.: 777,735

[22] Filed: Oct. 16, 1991

[51] Int. Cl.[5] ..... B22F 9/24; C22B 3/44

[52] U.S. Cl. ..... 75/370; 75/371; 75/741

[58] Field of Search ..... 75/370, 371, 741

[56] References Cited

U.S. PATENT DOCUMENTS

| | | | |
|---|---|---|---|
| 2,752,237 | 6/1956 | Short | 75/371 |
| 3,201,112 | 8/1965 | Wossner | 267/64 |
| 3,345,158 | 10/1967 | Block et al. | 75/371 |
| 3,717,453 | 2/1973 | Daiga | 75/371 |
| 3,816,097 | 6/1974 | Daiga | 75/252 |
| 4,979,985 | 12/1990 | Tosun et al. | 75/371 |

FOREIGN PATENT DOCUMENTS

| | | | |
|---|---|---|---|
| 2219531 | 11/1972 | Fed. Rep. of Germany . | |
| 1202712 | 1/1983 | U.S.S.R. | 75/371 |
| 1071367 | 2/1984 | U.S.S.R. | 75/371 |
| 2236116 | 3/1991 | United Kingdom | 75/370 |

OTHER PUBLICATIONS

Derwent Publications Ltd., Accession No. 88-246322/35, of Japanese Kokai No. 63-179011, Jul. 23, 1988.

*Primary Examiner*—George Wyszomierski

[57] ABSTRACT

A reductive process for making finely divided silver particles in which the silver particles are precipitated from an aqueous acid solution of silver salt containing silica sol.

11 Claims, No Drawings

PROCESS FOR MAKING FINELY DIVIDED PARTICLES OF SILVER METALS

FIELD OF THE INVENTION

The invention is directed to an improved process for making finely divided silver particles. In particular, the invention is directed to a process for making silver particles in the range of 1-3 μm with very narrow particle size distribution.

BACKGROUND OF THE INVENTION

Silver powder is widely used in the electronics industry for the manufacture of conductor thick film pastes. These thick film pastes are used to form conductive circuit patterns which are applied to substrates by screen printing. These circuits are then dried and fired to volatilize the liquid organic vehicle and to sinter the silver particles to form the conductor circuit pattern.

Printed circuit technology is requiring denser and more precise electronic circuits. To meet these requirements, the conductive lines have become more narrow in width with smaller distances between lines. The silver powders necessary to form more closely packed, narrower lines must be as close as possible to spherical in shape with narrow particle size distributions.

Many methods currently used to manufacture metal powders can be applied to the production of silver powders. For example, chemical methods, physical processes such as atomization or milling, thermal decomposition, and electrochemical processes can be used.

Silver powders used in electronic applications are generally manufactured using chemical precipitation processes. Silver powder is produced by chemical reduction in which an aqueous solution of a soluble salt of silver is reacted with an appropriate reducing agent under conditions such that silver powder can be precipitated. The most common silver salt used is silver nitrate. Inorganic reducing agents including hydrazine, sulfite salts, and formate salts can be used to reduce silver nitrate. These processes tend to produce powders which are very coarse in size, are irregularly shaped and have a large particle size distribution due to aggregation.

Organic reducing agents such as alcohols, sugars, or aldehydes are used with alkali hydroxides to create the reducing conditions for silver nitrate. Under these conditions, the reduction reaction is very fast and hard to control and produces a powder with residual alkali ions. Although small in size (<1 micron), these powders tend to have an irregular shape with a wide distribution of particle sizes that do not pack well. These types of silver powders exhibit difficult-to-control sintering and inadequate line resolution in thick film printed conductor circuits.

PRIOR ART

U.S. Pat. No. 2,752,237, Short, is directed to a process for making silver by precipitating $Ag_2CO_3$ from an aqueous $AgNO_3$ solution containing a small residual amount of $HNO_3$ using an excess of alkali metal salt. The basic $Ag_2CO_3$ suspension is then reduced with a reducing agent such as formaldehyde.

U.S. Pat. No. 3,201,112, Cuhra et al., is directed to a method for making small silver particles by precipitation of $Ag_2O$ from $AgNO_3$ solution by adding alkali hydroxide, (2) converting the $Ag_2O$ to silver formate with formaldehyde and then (3) heating the silver formate to dissociate the formate radical to produce gum protected metallic silver particles.

U.S. Pat. No. 3,345,158, Block et al. Silver crystallites are formed by adding formic acid to a boiling solution of $AgNO_3$ (pH=1).

U.S. Pat. Nos. 3,717,453 and 3,816,097, Daiga, disclose forming a solution of Ag and another metal other than Ag, reducing the solution to form a Ag-metal slurry, adding the slurry to a Au solution, which is reduced to precipitate Au particles. In another aspect, Daiga discloses forming a solution of Ag and another metal other than Ag, adding to the solution a gold sol and then reducing the slurry to precipitate particles of Ag and metal. The use of 5% wt. submicron particulate silica (basis metal) as an antiagglomerating agent is disclosed.

U.K. 2,236,116A, Scholten et al. discloses silver particles prepared by reduction of silver ions in an aqueous solution containing silver nitrate, ammonium formate and citrate ions at a temperature of at least 50° C. and preferably 60°-100° C. Upon completion of the reduction reaction, the particles are filtered off, washed and dried.

U.S.S.R. 1,202,712A, Stepanov et al. discloses the preparation of silver powder by precipitation from an aqueous dispersion of silver nitrate, sodium formate, colloidal silver and alcoholic solution of surfactant at pH 8-9. The reaction system is heated to boiling before filtering out the silver precipitate and washing.

U.S. Pat. No. 4,979,985, Tosun and Glicksman, discloses a process for making submicron size silver particles by precipitation from an aqueous acidic solution of silver salt, gelatin and alkyl acid phosphate. Water soluble formates are used as the reducing agent for the silver salt.

DE 2,219,531 is directed to a method of making silver powder by forming a silver complex compound and reducing the compound by adding a reducing agent such as hydrazine or sodium formate. The process is carried out at a basic pH.

J63179011, Tanaka Kikinzoku Kogyo. Monodispersed fine Ag particles are produced by precipitation from a solution of silver nitrate using D-erythrobic acid or its salts as reducing agent.

SU 1071367, Karlov et al., discloses the preparation of silver powder by precipitation of silver nitrate with hydroquinone in the presence of tetraethoxysilane in which the mole ratio of silver to tetraethoxysilane is from 1:0.05 to 1:0.06. (ca. 17:1 to 20:1)

SUMMARY OF THE INVENTION

This invention is directed to a method for making finely divided silver metal particles comprising the sequential steps of:

(1) forming a dilute aqueous silica sol and heating the dispersion to 70°-90° C.;

(2) while maintaining the temperature of the reaction system at 70°-90° C. and agitating the dispersion, slowly adding to the dispersion separately and simultaneously a dilute nonbasic aqueous solution of a silver salt and at least a stoichiometrically equivalent amount of a dilute aqueous solution of formate which materials coreact to effect precipitation of finely divided silver particles having silica adsorbed thereon, the agitation being sufficient to keep the precipitated silver particles in suspension;

(3) discontinuing addition of the reactant solutions and for a period of at least 1 hour maintaining the reaction dispersion at 80°–100° C. with sufficient agitation to keep the silver particles in suspension;

(4) discontinuing both agitation and heating of the suspension and holding the reaction dispersion for a period of at least 5 hours to effect cooling of the reaction dispersion and settling of the silver particles;

(5) separating supernatant liquid from the settled silver particles and with agitation resuspending the silver particles in water containing anionic or nonionic surfactant;

(6) separating the surfactant-containing water from the silver particles and washing the silver particles with additional water until the conductivity of the wash liquid is less than 20 micromhos;

(7) suspending the washed particles in an aqueous alkaline solution, heating the suspension to a temperature of 40° C. plus or minus 1° C. while agitating the suspension to maintain the silver particles in suspension and holding the suspension for a period of at least 2 hours to effect hydrolysis and removal of the adsorbed silica from the surface of the silver particles;

(8) separating the aqueous alkaline solution from the silver particles and washing them with water until the conductivity of the wash liquid is less than 20 micromhos; and (9) drying the washed silver particles from which the silica has been removed.

DETAILED DESCRIPTION OF THE INVENTION

The process of the invention is a reductive process in which finely divided silver particles are precipitated from an aqueous acid solution of a silver salt, in the presence of colloidal silica particles. The process proceeds by the following acidic reaction:

$$2AgNO_3 + NaCOOH \rightarrow 2Ag + CO_2 + NaNO_3 + HNO_3$$

Any water-soluble silver salt can be used in the process of the invention such as $Ag_3PO_4$, $Ag_2SO_4$, silver nitrate and the like. Insoluble silver salts such as AgCl are not, however, suitable.

Because the reactions of the process are in the liquid phase, operating pressure is not a critical variable and the process can be carried out most conveniently and economically at atmospheric pressure.

As the reducing agent for the process of the invention, any water-soluble formate can be used such as sodium formate, potassium formate or ammonium formate. The amount of formate to be used must be stoichiometrically sufficient to reduce all of the silver ions in the reaction solution and preferably in molar excess to assure removal of all the silver in the reaction solution. A molar excess of at least 0.1 mole/mole is preferred and 0.50 is still further preferred. Though still higher excesses of formate can be used in the process, they give no further technical advantage.

More particularly it is preferred that the concentration of silver salt in the dilute solution be from 0.7 to 3.0 millimoles/L and the concentration of formate be from 0.7 to 1.0 millimole/L. In order to obtain silver particles which are 1 micron or larger in size, it is necessary to add the reactants at a very slow rate. In the case of the dilute silver salt solution, the rate of addition shouild be no more than 4.0 millimoles/L/min. and in the case of the dilute formate solution, the rate of addition should be no more than 3.0 millimoles/L/min. (As used here, where L refers to the initial volume of the dilute aqueous silica sol.

For uniformity in the nature and quality of the precipitation step, it is preferred to use deionized water which has also been filtered to remove any particles larger than 0.2 micron.

It has been found advantageous to carry out the precipitation step in the presence of a small amount of a gold sol. In particular, it has been found that the presence of the colloidal size gold particles facilitates both better process reproducibility and narrower particle size distribution (PSD). On the order of $4\times10^{-6}$ g/L of gold sol (basis reactant solution) is effective for this purpose.

Though it is preferred to carry out the precipitation step of the process by adding the reactants separately and simultaneously to the dilute silica sol in the manner described hereinabove, it is nevertheless quite feasible first to form a solution which contains both the silica sol and the soluble formate and then slowly to add the dilute silver salt solution and the admixture of silica sol and formate to the reaction vessel containing water at the preferred reaction temperature. It is not, however, feasible to use a prereaction admixture of the silver salt and the silica sol. If the coreactant solutions are not added both separately and simultaneously and the silver solution is added to the silica sol in the reaction vessel, the silver powder which is formed upon addition of the formate reductant becomes highly agglomerated. As a result, the PSD becomes excessively wide and the powder contains irregularly shaped particles larger than 20 microns.

It has been found that the temperature of the precipitation is also important. For example, if the precipitation is carried out at a temperature higher than 90° C., excess evaporation of water occurs and precise control of the process becomes difficult. On the other hand, if the precipitation is carried out at a temperature below 60° C., the particles produced tend to have irregular shapes and to agglomerate. For that reason, the precipitation step should be carried out at temperature of 70°–90° C. and preferably at 75°–85° C.

The process of the invention is carried out at nonbasic conditions in order to obtain a lower reaction rate and better control over the reaction rate. Basic processes for the precipitation of silver are not preferred for the reason that the resultant silver particles are too small and silver oxide ($Ag_2O$) is formed as an intermediate of limited solubility. On the other hand, in the process of the invention, all reactant species are soluble.

It is unnecessary to adjust the pH of the invention process since the presence of silver nitrate renders the initial reaction solution acidic and the evolution of carbon dioxide and nitric acid during the process keeps the reaction solution in the acid state.

While carrying out the precipitation step it is necessary to keep the precipitated silver particles dispersed in the reaction solution in order to provide spatially homogeneous particle growth conditions and thus to prevent widening of the particle size distribution. This is done by agitating the reaction solution.

Upon completion of the addition of the coreactants, it is necessary to hold the dispersion of silver particles for a substantial period of time to facilitate completion of the precipitation reactions and stabilization of the reaction system. At least one hour is needed for this step and two hours are preferred. Holding times greater than two hours do no harm, but have not been found to improve either the yield or the quality of the precipitated particles.

Following the holding step, both heating and agitation of the dispersion are stopped and the particles are allowed to cool and to settle to the bottom of the reactor. A period of at least 5 hours is preferred for this function in order to insure that all of the particles are settled.

Following settling of the silver particles, the supernatant liquid from the reaction is removed from the reactor and the silver particles are resuspended in water containing a small amount of anionic or nonionic surfactant. If desired, high sheer mixing can be used to assist in breaking up agglomerates that may have been formed in the previous steps of the process. The water is then removed from the suspension by filtration or other suitable liquid-solid separation operation and the solids are washed with water until the conductivity of the wash water is 20 micromhos or less and preferably 10 micromhos or less.

The thusly washed silver particles are then resuspended in an aqueous alkaline solution which also contains a small amount of anionic or nonionic surfactant and the suspension is heated to 40° C. The purpose of this step is to hydrolyze and thus solubilize the $SiO_2$ adsorbed on the particle surfaces and then remove it from the surfaces. While it is preferred to use NaOH for this purpose, other alkaline materials such as KOH and $NH_4OH$ can be used instead. Quite surprisingly, it has been found that the temperature of this step is quite important and must not deviate more than about 1° C. from the 40° C. temperature. If the temperature substantially exceeds 40° C., the particles are more likely to undergo agglomeration and if the temperature is substantially below this temperature, the amount of $SiO_2$ remaining on the particles will be too high. It is preferred to carry out this step over a period of at least 1 hour and preferably at least 2 hours to allow for complete removal of the $SiO_2$. Holding times of greater than 3 hours have not, however, been found to have any significant additional benefit.

After the suspension has been treated with aqueous base for sufficient time to hydrolyze the $SiO_2$, the water is again removed from the suspension and the particles are washed with water to remove the $SiO_2$ from the particle mass. As before, it is preferred to use filtered and deionized water for this function and washing is continued until the conductivity of the wash water is 20 micromhos or less and preferably 10 micromhos or less.

Following this last wash step, the water is separated from the silver particles and the particles are dried.

It will be realized by those skilled in solids-liquid separations that the water can be removed from the wet particles by conventional separation methods such as decantation, filtration, centrifugation and the like. The particles with most of the water removed therefrom are then washed with water, preferably deionized water, to remove adsorbed $SiO_2$ and ionic species from the surface of the particles. This is done by repeatedly washing the particles in water until the electrical conductivity of the wash solution is below about 20 micromhos and preferably below about 10 micromhos. The washed particles are then dried by such techniques as oven drying, freeze drying, vacuum drying, air drying and the like and combinations of such techniques.

Silica Sol

The silica sols used in the practice of the invention are aqueous colloidal dispersions of silica particles in an alkaline medium. Because the alkaline medium reacts with the silica surface to produce a negative charge, the particles repel each other and thus make the dispersion quite stable. The stabilizing alkali in the silica sols used in the Examples below was NaOH, though other alkaline materials such as ammonium hydroxide can also be used.

Suitable silica sols are available in commercial quantities in $SiO_2$ concentrations from 30 to 50% by weight with pH values ranging from 8.1 to 10.0 and $SiO_2$ particle sizes of from 7 to 22 nm. A preferred silica sol is LUDOX AM in which the stabilizing counter ion is sodium, pH is 8.8, $SiO_2/Na_2O$ ratio by weight is 125, particle size is 12 nm and the $SiO_2$ concentration is 30% by weight. The surface of the $SiO_2$ particles in this material is modified with aluminum ions. In particular, trivalent Al atoms are substituted for part of the tetravelent Si atoms in the surface of the particles, which creates a negative charge which is independent of pH. Thus, when the pH of the sol is reduced, the amount of charge resulting from the reaction between hydroxyl ions and surface silanol group is reduced. This results in increased stability as the pH of the sol is lowered. (Ludox ® is a tradename of E. I. du Pont de Nemours and Company, Wilmington, DE, for colloidal silica.)

Surfactant

The method of the invention requires the use of a surfactant in the steps following precipitation and prior to removal of the silica from the surfaces of the silver particles. Preferred surfactants for use with alkaline silica sols of the type used in the invention are either anionic or non-ionic. Preferred anionic surfactants are those having sodium as the cation and a sulfated fatty alcohol or sulfonated alkyl or aryl hydrocarbon radical as the anion.

Cationic surfactants, such as quaternary ammonium chloride types, may not be used in the invention for the reason that they cause precipitation of the colloidal $SiO_2$ particles.

EXAMPLES

General Procedure

A series of 13 batches of silver particles was prepared by the following procedure to observe the effect of process variables on the properties of the precipitated silver particles. The data for these batches are given below in Table 1. The general description of the experimental procedure below refers to the figures in Table 1 for specific values of concentrations, temperature, etc.

In a 1-liter glass reaction vessel with baffles and agitation, put 600 cc DI water that has been filtered through a 0.2 micrometer filter. Add gold sol (0.05 g gold/L, mean size 0.1–0.2 micrometer) and Ludox ® AM (30 wt % silica sol, type AM unless specified to be a different Ludox ®) in the concentrations specified. Heat to reaction temperature with agitation. In separate vessels, prepare the $AgNO_3$ and HCOONa solutions in the same (DI) filtered water at concentrations specified. Start feeding the above solutions to the reaction vessel at 0.75 cc/min flow rate each, with agitation sufficient to suspend the solid product uniformly in the liquid medium. Maintain feed flows for 255 minutes. Discontinue feeding and maintain agitation at the specified temperature for 120 minutes. Discontinue both agitation and heat. Let stand 16 hrs.

Remove supernatant liquid. Add 300 ccs DI water and 8 drops of Tergitol TMN 6 to the reaction vessel. Agitate for 5 minutes to re-suspend the solids. Filter and wash the solids to 10 micromho conductivity.

Prepare 600 ccs of 1.0 wt.% NaOH solution in the clean reaction vessel (unless a different concentration is specified). Add 5 drops of Tergitol TMN 6. Add washed solids and with sufficient agitation to keep solids in suspension, heat to 40° C. (plus or minus 1° C.). Hold for 2 hours.

Discontinue heat and agitation. Filter and wash to 5 micromhos conductivity. Freeze dry.

In Table 1, each batch is referred to as an Example in Column 1. Columns 2–8 are from direct measurements and calculations. Yield in Column 8 is based on the maximum theoretical amount of silver available in $AgNO_3$ fed to the vessel. Silicon content (ppm) in Column 9 is from ICP analysis. Columns 10–12 are particle size distribution data from Microtrac-SPA measurements following freeze drying, dispersion in GAFAC RE-610 and ultrasound deagglomeration (15 mins at 500 W). All values in Columns 10–12 are in micrometers, $d_{50}$ is the mass-average median diameter. PSD Minimum and PSD Maximum stand for the lowest and highest diameters for which Microtrac showed non-zero readings. Remarks in Column 13 refer to conditions of each example to those of Example 1. Example 1 is designated as the Base Case and the remarks indicate the difference(s) between the particular example and Example 1, the base case. Thus, "2×conc. of feeds" means that the concentration of the feed solutions was twice the values in Example 1. These remarks simply emphasize information that can be found in Columns 2–7. They do not introduce any new information.

Brief discussion of each experiment and the product powder is given below.

DESCRIPTION OF EXAMPLES

In the following description of the Examples, the term "fused aggregation" is used to describe the appearance in SEM photomicrographs of aggregates of elementary particles that have lost part of their initial shapes due to partial coalescence. Agglomeration, on the other hand, is meant to signify aggregates where the elementary particles still exhibited complete spheroidal shapes.

EXAMPLE 1

Following the above general procedure with the conditions shown in Cols. 2–7 of Row 1 in Table I resulted in a spheroidal powder with $d_{50}$ of 1.43 microns and a size range of 0.34 to 5.27 microns with 90% of the powder in the 0.4 to 3.0 micron range. Silicon content was 120 ppm. Yield based on silver was 75%.

EXAMPLE 2

Concentrations of the feed solutions, Ludox®, and gold sol were 1/2×base values. Reaction temperature was 60° C. Product powder had $d_{50}$ of 2.06 and range 0.34–10.55. SEM photomicrographs indicated more irregular and a more aggregated morphology than the base case. Yield was only 53%, probably due to lower reaction temperature.

EXAMPLE 3

Concentrations of the feed solutions were 2×base values. All other variables were unchanged. The powder had a $d_{50}$ of 2.49 and range 0.34–10.55. SEM photos showed that the powder had considerably more fused aggregation than the base case.

EXAMPLE 4

Concentration of Ludox® AM was 2×base value with other variables unchanged. The product powder had primary particles of quite uniform size around 0.4 micron but apparently aggregated to the extent that Microtrac measurements were meaningless. Hence Cols. 10–12 have NM for PSD data for this example indicating "not measurable". The yield in this example was also only 47% compared to the 75% of the base case. (It is believed that the concentration of Ludox® has an inverse effect on yields, possibly through an inhibition mechanism).

EXAMPLE 5

With feed and Ludox® concentrations 2×base values, a power that is similar to the base case but, somewhat more aggregated, was produced.

EXAMPLE 6

The reactant mole ratio ($HCOO^-/Ag^+$) was 2.0 instead of the base value of 0.75 in the rest of the series of examples. SEM photomicrographs showed an extremely irregular morphology drastically different from the base case. Flat plates and highly fused aggregates were common in these photos. Relatively high value for $d_{50}$ (2.96) in Table I also reflects the extensive aggregation in this powder.

EXAMPLE 7

In this example, no gold sol was used with all other variables exactly the same as the base case. The product powder had slightly smaller $d_{50}$ (1.23) and a larger size range than the base case (0.34–10.55). The powder had a much lower yield (50%) and much higher Si content (290 ppm vs 120) than the base case.

EXAMPLE 8

In this example, Ludox® LS was used instead of Ludox® AM. The product powder had larger $d_{50}$ (1.67) and wider range (0.17–14.92) than base case. SEM photos showed greater aggregation and some rather large (ca. 10 micron in average dimension) particles.

EXAMPLE 9

The water used for the reaction step, including the feed solutions, was not filtered as described in the General Procedure. All other variables were identical to base case. The product powder exhibited extensive fused aggregation indicated by a range that exceeded the Microtrac-SPA limits of 0.17–42.2. It also had low yield (65%) and high Si (250 ppm).

EXAMPLE 10

Ludox® AM was added to the formate feed solution instead of the reaction vessel before the start of the reaction as called for in the General Procedure. Product powder had a slightly lower $d_{50}$ (1.30) and slightly wider range (on the lower end) than base case. The yield was also lower (66 vs 75%). SEM photos showed spheroidal shape for the primary particles.

EXAMPLE 11

Ludox® AM concentration was 1/2×base value with other variables unchanged. Product powder had $d_{50}$ of 2.35 and range 0.34–10.55. SEM photos indicated considerably more fused aggregation than the base case. Si content was 79 ppm vs 120.

EXAMPLE 12

The reaction temperature was 60° C. versus 80 for the base case. All other variables were unchanged. SEM photos showed a powder with very irregular morphology including flat plates and extensive fused aggregation of quite small spherical particles. Yield was also lower (68%) than base case.

EXAMPLE 13

The concentration of the reactants in the feed solutions were 1/2×base case values with all other variables unchanged. Product powder had the smallest $d_{50}$ of the series (0.93) and fairly narrow range (0.17–5.27). SEM photos showed a quite narrow size distribution for the primary particles around a mean of about 0.4 micron. Yield was lower (64%) and Si content was significantly higher (295 ppm) than the base case.

TABLE I

SUMMARY DESCRIPTION OF EXAMPLES

| Ex. No. | Feed Conc. [$Ag^+$] (gmol/L) | Feed Conc. [HCOO] (gmol/L) | Au sol. (cc/L) | Ludox® AM (cc/L) | Rxn Temp. (°C.) | Wt % NaOH | Silver Yield (%) | Si (ppm) | $d_{50}$[1] | PSD[1] Min. | PSD[1] Max. | Remarks |
|---|---|---|---|---|---|---|---|---|---|---|---|---|
| 1 | 1.47 | 1.10 | 0.75 | 0.60 | 80 | 1.0 | 75 | 120 | 1.43 | 0.34 | 5.27 | Base case |
| 2 | 0.74 | 0.55 | 0.40 | 0.30 | 60 | 1.0 | 53 | 165 | 2.06 | 0.34 | 10.55 | ½ × concs. (all) Temp. 60° C. |
| 3 | 2.94 | 2.20 | 0.75 | 0.60 | 80 | 1.0 | 77 | 67 | 2.49 | 0.34 | 10.55 | 2 × conc. of feeds |
| 4 | 1.47 | 1.10 | 0.75 | 1.20 | 80 | 1.0 | 47 | 175 | NM | NM | NM | 2 × conc. of Ludox® AM |
| 5 | 2.94 | 2.20 | 0.75 | 1.20 | 80 | 2.0 | 77 | 120 | 1.89 | 0.24 | 10.55 | 2 × conc. of feeds and Ludox® AM |
| 6 | 1.47 | 2.94 | 0.75 | 0.60 | 80 | 1.0 | 81 | 140 | 2.96 | 0.17 | 10.55 | $C_{Ao}/C_{Bo} = 2.0$ |
| 7 | 1.47 | 1.10 | 0.00 | 0.60 | 80 | 1.0 | 50 | 290 | 1.23 | 0.17 | 10.55 | No Au sol |
| 8 | 1.47 | 1.10 | 0.75 | 0.60 | 80 | 1.0 | 64 | 135 | 1.67 | 0.17 | 14.92 | Ludox® LS vs. AM |
| 9 | 1.47 | 1.10 | 0.75 | 0.60 | 80 | 1.0 | 65 | 250 | 1.56 | 0.17 | 42.2 | Unfiltered $H_2O$ for reaction |
| 10 | 1.47 | 1.10 | 0.75 | 0.60 | 80 | 1.0 | 66 | 155 | 1.30 | 0.17 | 5.27 | Ludox® AM in formate feed |
| 11 | 1.47 | 1.10 | 0.75 | 0.30 | 80 | 1.0 | 71 | 79 | 2.35 | 0.34 | 10.55 | ½ × conc. of Ludox® AM |
| 12 | 1.47 | 1.10 | 0.75 | 0.60 | 60 | 1.0 | 68 | 94 | 1.78 | 0.17 | 10.55 | Rxn. temp. 60° C. |
| 13 | 0.74 | 0.55 | 0.75 | 0.60 | 80 | 1.0 | 64 | 295 | 0.93 | 0.17 | 5.27 | ½ × conc. of feeds |

[1]From Microtrac-SPA measurements
NM Not measurable

What is claimed is:

1. A method for making finely divided silver metal particles comprising the sequential steps of (1) forming a dilute aqueous silica sol and heating the sol to 70°–90° C.;

(2) while maintaining the temperature of the sol at 70°–90° C. and agitating the sol, slowly adding to the sol separately and simultaneously dilute aqueous solutions of a silver salt and formate which coreact to effect precipitation of finely divided silver particles capable of adsorbing silica, the agitation being sufficient to keep the precipitated particles in suspension;

(3) discontinuing addition of the aqueous solutions and for a period of at least one hour maintaining the suspension at 80°–100° C. with sufficient agitation to keep in suspension the precipitated particles;

(4) discontinuing both agitation and heating of the suspension and holding the suspension for a period of at least 5 hours to effect cooling of the suspension and settling of the precipitated particles;

(5) separating supernatant liquid from the settled particles and with agitation resuspending the particles in water containing a nonionic surfactant;

(6) separating the surfactant-containing water from the particles and washing the particles with additional water until the conductivity of the wash liquid is less than 20 micromhos;

(7) suspending the washed particles in an aqueous alkaline solution, heating the suspension to a temperature of 40° C.±1° C. while agitating the suspension to maintain the particles in suspension and holding the suspension for a period of at least 2 hours to effect hydrolysis and removal of the adsorbed silica from the particles;

(8) separating the aqueous alkaline solution from the particles and washing the particles with water until the conductivity of the wash liquid is less than 20 micromhos; and (9) drying the washed silver particles from which the adsorbed silica has been removed.

2. The method of claim 1 in which the silver salt is silver nitrate.

3. The method of claim 1 in which the formate is sodium formate.

4. The method of claim 1 in which the water of the aqueous solutions has been filtered and deionized.

5. The method of claim 1 in which alkali of the aqueous alkaline solution is sodium hydroxide.

6. The method of claim 1 in which the dilute silica sol is formed by diluting an aqueous silica sol with water.

7. The method of claim 1 in which the dilute silica sol also contains colloidal particles of gold.

8. The method of claim 1 in which the dilute silver salt solution rate of addition is no more than 4.0 millimoles/L/min. and the dilute formate solution rate of addition is no more than 3.0 millimoles/L/min., where L refers to the initial volume of the dilute aqueous silica sol.

9. A method for making finely divided silver metal particles comprising the sequential steps of (1) forming an admixture of a silica sol and a soluble formate and heating the admixture to 70°–90° C.;

(2) while maintaining the temperature of the admixture at 70°–90° C. and agitating the admixture, slowly adding a solution of dilute silver salt and the admixture separately and simultaneously to water which coreact to effect precipitation of finely divided silver particles capable of adsorbing silica, the agitation being sufficient to keep the precipitated particles in suspension;

(3) discontinuing addition of the solution and the admixture and for a period of at least one hour maintaining the suspension at 80°-100° C. with sufficient agitation to keep in suspension the precipitated particles having silica adsorbed thereon;

(4) discontinuing both agitation and heating of the suspension and holding the suspension for a period of at least 5 hours to effect cooling of the suspension and settling of the precipitated particles;

(5) separating supernatant liquid from the settled particles and with agitation resuspending the particles in water containing a nonionic surfactant;

(6) separating the surfactant-containing water from the particles and washing the particles with additional water until the conductivity of the wash liquid is less than 20 micromhos;

(7) suspending the washed particles in an aqueous alkaline solution, heating the suspension to a temperature of 40° C.±1° C. while agitating the suspension to maintain the particles in suspension and holding the suspension for a period of at least 2 hours to effect hydrolysis and removal of the adsorbed silica from the particles;

(8) separating the aqueous alkaline solution from the particles and washing the particles with water until the conductivity of the wash liquid is less than 20 micromhos; and (9) drying the washed silver particles from which the adsorbed silica has been removed.

10. The method of claim 9 in which the alkali of the aqueous alkaline solution is sodium hydroxide.

11. The method of claim 10 in which the silica sol also contains colloidal particles of gold.

* * * * *